United States Patent [19]

Orlowski

[11] Patent Number: 4,538,999

[45] Date of Patent: Sep. 3, 1985

[54] SPINNING TOY

[75] Inventor: Gerald J. Orlowski, Scottsdale, Ariz.

[73] Assignee: Fun-Tech Products Company, Phoenix, Ariz.

[21] Appl. No.: 577,197

[22] Filed: Feb. 6, 1984

Related U.S. Application Data

[63] Continuation of Ser. No. 249,776, Apr. 1, 1981, abandoned.

[51] Int. Cl.[3] ..... A63H 11/02; A63H 11/20; A63H 13/16

[52] U.S. Cl. ..... 446/259; 446/263; 446/310

[58] Field of Search ..... 446/259, 263, 264

[56] References Cited

U.S. PATENT DOCUMENTS

| | | | |
|---|---|---|---|
| 870,146 | 11/1907 | Webb | 46/72 |
| 886,595 | 5/1908 | Glasscock | 46/72 |
| 990,130 | 4/1911 | Heider | 46/72 |
| 2,023,124 | 12/1935 | Dickover | 46/86 |
| 2,547,369 | 4/1951 | Bourelle et al. | 46/72 |
| 2,610,440 | 9/1952 | Manske et al. | 46/72 X |
| 2,675,642 | 4/1954 | Coleman et al. | 46/86 |
| 2,718,093 | 9/1955 | Payne | 46/86 |
| 3,045,392 | 7/1962 | Martin | 46/228 |
| 3,134,194 | 5/1964 | Boswell | 46/74 |
| 3,445,954 | 5/1969 | Wahl | 46/86 |

*Primary Examiner*—F. Barry Shay

*Attorney, Agent, or Firm*—Charles E. Cates; Victor Myer; James H. Phillips

[57] ABSTRACT

A spinning toy having a hollow housing, a detachable cover, a cargo carrier in the housing, means responsive to attachment of the cover to engage first detent means, means for rotating the toy, means for retaining the cover on the housing as the toy is rotated, means responsive to centrifugal force for transferring the engagement to second detent means, and means responsive to a decrease in centrifugal force for disengaging the second detent means and means for ejecting the cover and cargo upon release of the second detent means; and a launcher that serves as means for retaining the cover on the housing during the transition from first to second detent means, the launcher having means for disengaging the toy and moving it away to spin freely.

6 Claims, 5 Drawing Figures

SPINNING TOY

This case is a continuation of application Ser. No. 249,776, filed 04/01/81, now abandoned.

BACKGROUND OF THE INVENTION

1. Field of the Invention

The invention relates to spinning toys and jack-in-the-box toys.

2. Description of the Prior Art

The prior art contains spinning tops and various means for causing objects to jump out of boxes. So far as known to applicant, this invention is the first spinning toy that can be spun with a cargo inside and that causes the cargo to be ejected as the spinning toy decreases in velocity.

SUMMARY OF THE INVENTION

The invention is a hollow spinning toy that can carry a cargo inside its housing and eject the cargo when a desired speed is attained. A cover is provided which, when put in place, cocks an ejection mechanism and causes detent means in the housing to be based to a first detent position engaging the cover. With the cover in place the housing is combined with a launcher and rotatably, axially confined by its cover and bottom by suitable means in the launcher. The housing is spun with a suitable means while the ends of the axis of rotation are so confined by the launcher, the spin causing the detent means to move to a second detent position responsive to radial movement of weight in the housing as centrifugal force causes the weights to move radially outward, overcoming the bias. Means carried by the launcher for releasing the spinning housing are activated and the latter spins free. During the first part of the spin the detent is maintained in the second detent position. As the spinning slows down, the bias means overcomes the centrifugal force, moving the weights, and causing the connected detent to move to a center non-detent, or release, position. The ejection means ejects the cover and the cargo, to the delight of the children (of all ages).

In another expression, the invention is a spinning toy having a hollow housing, a detachable cover, a cargo carrier in the housing, means responsive to attachment of the cover to engage first detent means, means for rotating the toy, means for retaining the cover on the housing as the toy is rotated, means responsive to centrifugal force for transferring the engagement to second detent means, and means responsive to a decrease in centrifugal force for disengaging the second detent means and means for ejecting the cover and cargo upon release of the second detent means; and a launcher that serves as means for retaining the cover on the housing during the transition from first to second detent means, the launcher having means for disengaging the toy and moving it away to spin freely.

The invention is further summarized in the claims which are a part of the specification.

BRIEF DESCRIPTION OF THE DRAWING

Turning now to the drawing in which a presently preferred embodiment is illustrated.

DESCRIPTION OF THE PREFERRED EMBODIMENTS

Figure 1:
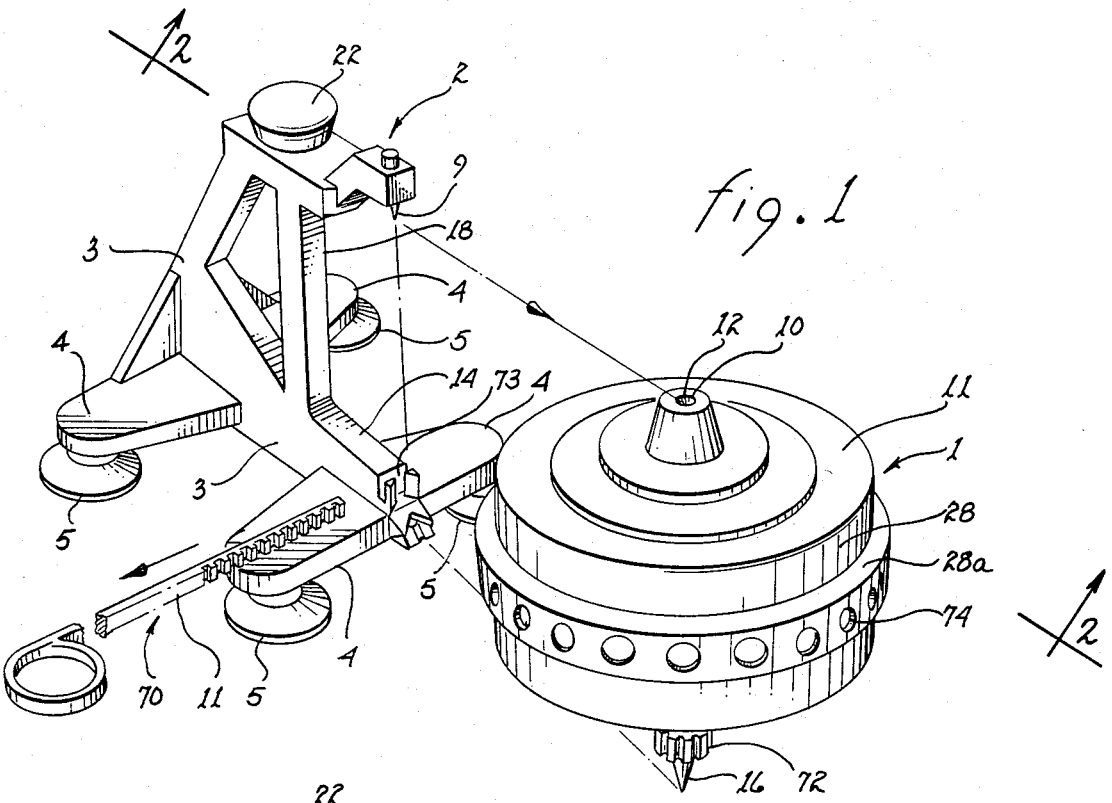
FIG. 1 is an isometric view of the two major toy components: launcher and housing.
Figure 2:
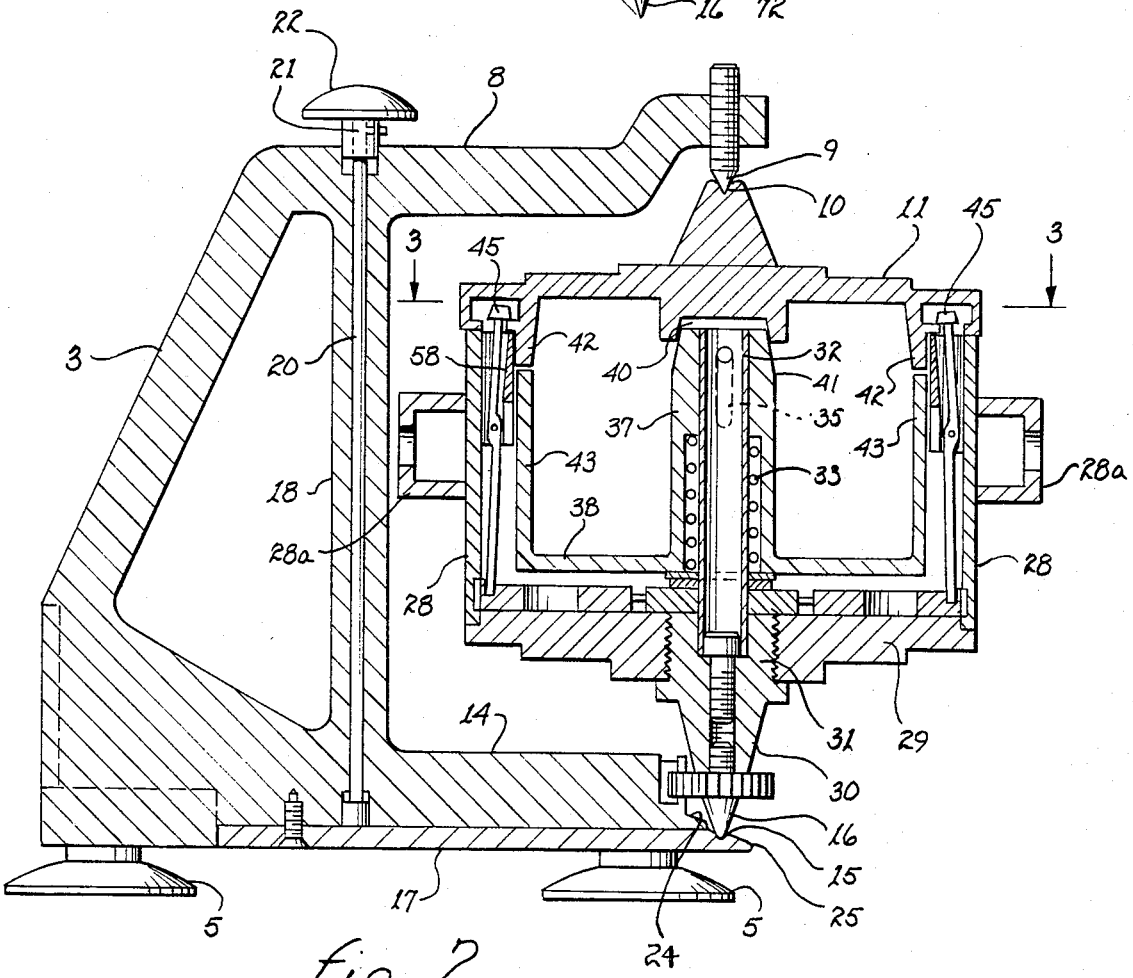
FIG. 2 is a sectional view of the device of FIG. 1 taken along the lines 2—2.

Referring first to FIGS. 1 and 2 wherein a presently preferred embodiment is illustrated, the two major components are the housing 1 and launcher 2. The latter has a frame 3 having four pedestals 4 with vacuum cups.

An upper arm 8 has a needle point 9 which engages a suitable mating dimple 10 on the cover 11 of the housing 1 at a point which defines the upper end 12 of the axis of rotation.

A lower arm 14 has a flexible member 17 having an indentation 15 to receive rotation point 16 of the housing on the axis of rotation which point 16 defines the lower end of the axis of rotation.

The frame 3 has an upright brace 18 through which a bore is drilled to receive a push rod 20 one end 21 of which rests on washer 32*a* and is provided with a finger button 22.

In FIG. 1 it will be seen that launcher 2 is provided with a plastic rack gear 70 which has a rack 71 for casting with pinion 72. The rack travels in guide 73 and the pinion is carried by plug 30. The rack is pulled while engaging the pinion to cause it to spin the toy in a known manner.

A push on the button 22 depresses flexible member 17 thereby causing the spinning housing 1 to be lowered away from pin 9 while spinning in indentation 15. During this lowering movement the spinning toy is urged out of indentation 15 when the inclined side of point 16 touches projection 24. This action nudges the point 16 out of indentation 15 to gently slide the spinning toy down ramp 25 to spin free on the floor.

In FIG. 1 the housing has been launched. In FIG. 2 it is shown as it appears spinning at cruising speed, ready to launch. Referring specifically to FIG. 2, the housing has a cylindrical wall 28 and a floor 29 which latter is tapped for reception of a plug 30 which in turn is bored to receive the rotation point 16 on the axis of rotation. The upper end 31 of the plug 30 is tapped to receive a hollow cylinder 32. Around cylinder 32 is a coil spring 33 which is compressed between the plug 30 and the platform wall 37. Pin 34 is attached to cylinder 32. Wall 37 of cargo platform 38 is an enclosing tube that is guided on cylinder 32. Coil spring 33 normally biases platform 38 to the eject position (see FIG. 5). However, when the cover 11 is placed, well 40 cups over tapered end 41 of wall 37 to position and, in concert with projection 42, engages the wall 37 and wall 43 to push the platform 38 into the housing 1, thereby compressing spring 33.

The travel or stroke of platform 38 is determined by slot 35 which engages fixed pin 34. The two elements cooperate to limit axial movement of the platform 38.

Figure 3:
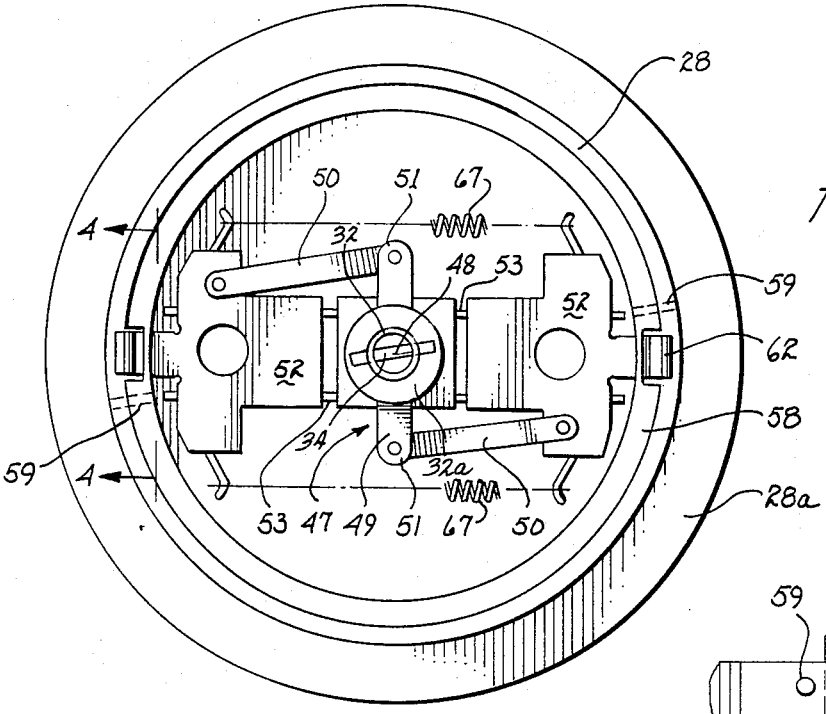
FIG. 3 is a plan view of the housing of FIG. 2 with the cover and platform 38, walls 37, 43 and spring 33 removed to show certain mechanism.

When the cover 11 is in place latches 45 engage first detent position 64 which is opposite (radially out from) the position shown in FIG. 2. Referring to FIG. 3, it may be seen that toggle linkage 47 has a pivot point 48 on the axis of rotation, a center arm 49 pivotally mounted at its mid-point, slave links 50 whose ends are pivotally attached to the ends 51 of the center arm and to weights 52 in a manner which assures that, as weights 52 slide axially in and out on guide rods 53, the weights will be equidistant from the axis of rotation and pivot point 48.

Figure 4:
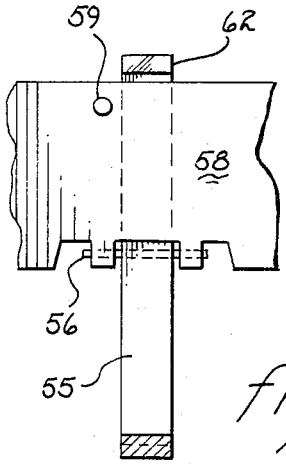
FIG. 4 is a partial elevation view of a portion of the housing of FIG. 3, taken in section along the lines 4—4.
Figure 5:
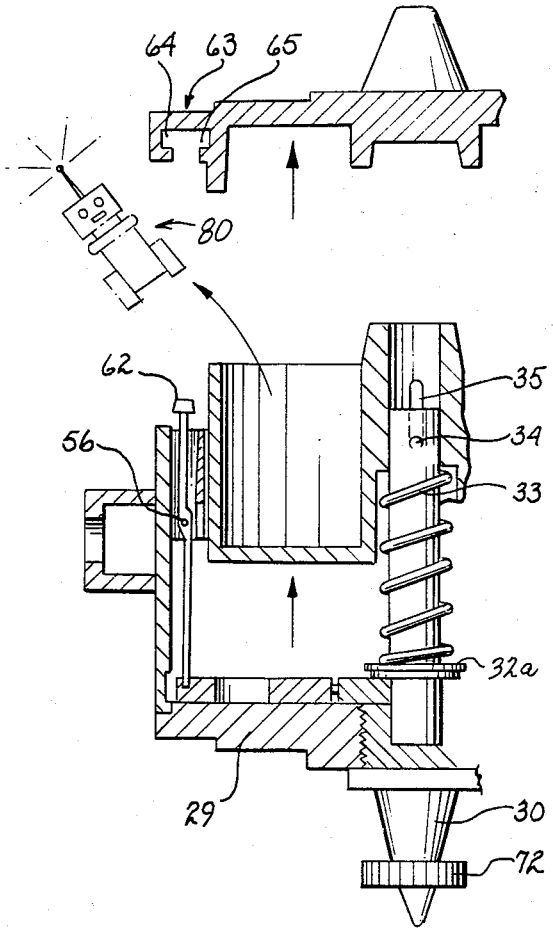
FIG. 5 is a partial elevation view, in section, of the device in the ejection mode.

As better seen in FIGS. 4 and 5, the weights pivotally engage levers 55 which in turn are pivotally secured on pins 56 carried by ring 58 which latter is snug fitted into housing 1 and secured by set screws 59. (This lever assembly may be easily removed.)

The upper ends of the levers 55 have bidirectional latches 62 serving to engage catches 63 which are best seen in FIG. 5 wherein a first detent position 64 and a second detent position 65 are indicated. When the cover is placed, the springs 67 bias weights 52 radially inward. The action on levers 55 moves latches 62 to the first detent position 64.

When housing 1 is placed in the launcher 2, the cover 11 and rotation point are engaged by upper and lower arms 8, 14 of the launcher and, thus confined, the cover cannot be ejected by spring 33.

When the housing is spun the weights, under the influence of centrifugal force, overcome the bias of the springs 67 and move radially outward causing levers 55 to move the latches 62 from the first detent position 64 to the second detent position 65. (The latter is shown in FIG. 2.) While the changeover is being effected, the launcher arms keep cover and housing together. When the speed of rotation required to accomplish this is attained (referred to for convenience as cruising speed) the button 22 may be pushed, setting off a sequence heretofore described which results in a free spinning toy.

As the rate of spin decreases the cruising speed threshold will be crossed again and the bias of springs 67 will overcome centrifugal force and move the weights axially inward.

As the latch 45 leaves the second detent position the cover, no longer independently confined by the launcher, is released and the stored force of spring 33 moves platform 38 and cover 11 axially. The axial movement of wall 37 is abruptly halted by pin 34 but the cover and the cargo on the platform are not so limited and are ejected.

A decorative rim 28*a* is carried by the wall 28 and portholes 74 are simulated for decoration.

The toy may be made of various materials: metal and plastic being preferred, and particularly high impact polystyrene. However, materials selection form no part of the invention and may be dictated by price and market considerations in particular cases, as is known in the art. Various parts may be cast or machined which is also within the skill of the art.

OPERATION

Objects 80 such as replicas of men and machines may be placed on the platform 38. The cover is placed on the housing which is then inserted into the launcher. The housing is spun by means of rack gear 70 and released to spin free. The cover flies off and the cargo is ejected when the spinning rate slows to the proper value.

While the presently preferred embodiment is shown and described, it will be appreciated that various equivalent structures will become apparent to persons skilled in the art from the teachings of this disclosure.

What is claimed is:

1. A spinning toy comprising:

a. a housing having:

(1) side walls and a connecting floor defining a cargo chamber with an opening at the top;

(2) cover means for covering at least a portion of said opening and registering with a portion of the side walls;

(3) an axis of rotation;

(4) means defining the upper and lower ends of said axis, said upper end means carried by said cover and said lower end means carried by the floor of said housing;

(5) releasable detent means carried by said housing sequentially responsive to (a) registering said cover with said side walls for engaging said cover in a first detent position; (b) the increase of rate of spin of said housing to cruising speed for engaging said cover in a second detent position; and (c) a decrease of rate of spin to less than cruising speed range for releasing said cover from said second detent position;

(6) means for ejecting said cover and the cargo responsive to the release of said cover;

b. a launcher having:

(1) means for rotatably engaging and confining of said means defining the upper and lower ends of said axis of rotation against axial movement to prevent separation of housing and cover;

(2) means for spinning said housing to attain cruising speed; and (3) means for releasing means defining the upper and lower ends of said axis of rotation to permit housing to spin free.

2. The toy of claim 1 wherein said releasable detent means comprise counterbalanced radially slidable weights, means for slidably mounting the weights on the housing, a pivot arm responsive to movement of said weights, a bi-directional latch carried at one end of said pivot arm and adapted to move radially responsive to radial movement of the weights, elastic means urging said weights in a first radial direction, first catch means carried by said cover for engaging said latch in said first detent position and second catch means carried by said cover for engaging said latch in said second detent position; whereby, sequentially, when said cover is put in place said first catch means engages said latch as said housing is rotated to attain cruising speed, thereafter centrifugal force cause said weights to overcome the bias of said elastic means and shift radially whereby said latch shifts from said first to second detent position while said upper and lower ends of means defining the rotation are confined by said launcher, and thereafter said latch disengages from said second detent position and moves to a release position as the force of said spring overcomes the centrifugal force of the spin.

3. The toy of claim 2 wherein said means for ejecting said cargo comprises guide means, a cargo support means adapted to move on said guide means, resiliently deformable means for urging said cargo support means on said guide means axially toward said top opening, and stop means for limiting said axial movement of said platform.

4. The toy of claim 1 wherein said means for ejecting said cargo comprises guide means, a cargo support means adapted to move on said guide means, resiliently deformable means for urging said cargo support means on said guide means axially toward said top opening, and stop means for limiting said axial movement of said platform.

5. The toy of claims 1 or 2 wherein the means for rotably engaging said means defining the upper and lower ends of said axis of rotation comprise an upper arm and a flexible lower arm, and the means for releasing said means defining the upper and lower ends of said axis comprises means for deflecting said flexible arm and a projection on said arm adapted to touch said means defining the lower end of said axis when the arm is flexed and thereby move said housing out of the launcher.

6. A spinning toy having a hollow housing, a detachable cover, to said housing a cargo carrier in the housing, means in said housing responsive to attachment of the cover thereof to engage first detent means, means for rotating the toy, means in said housing for retaining the cover on the housing as the toy is rotated, means in said housing responsive to centrifugal force for transferring the engagement to second detent means, and means in said housing responsive to a decrease in centrifugal force for disengaging the second detent means whereby said cover is released and means for ejecting the cover and cargo upon release of the second detent means; and a launcher that serves as means for retaining the cover on the housing during the transition from first to second detent means, the launcher having means for disengaging the toy and moving it away to spin freely.

* * * * *